United States Patent [19]

LaChance

[11] Patent Number: 4,515,242

[45] Date of Patent: May 7, 1985

[54] MOVABLE HAND RAILING AND TRAY FOR LADDERS

[76] Inventor: Paul LaChance, 100 Division St., Rockland, Mass. 02370

[21] Appl. No.: 554,786

[22] Filed: Nov. 23, 1983

[51] Int. Cl.[3] ..... E06C 7/14; E06C 7/18

[52] U.S. Cl. ..... 182/106; 182/129; 248/238

[58] Field of Search ..... 182/106, 129, 116; 248/210, 211, 238

[56] References Cited

U.S. PATENT DOCUMENTS

| | | | |
|---|---|---|---|
| 2,542,737 | 2/1951 | Vogel | 248/211 |
| 2,759,620 | 8/1956 | Pharris | 248/210 |
| 2,883,134 | 4/1959 | O'Halloran | 248/210 |
| 3,067,836 | 12/1962 | Carnicelli | 182/121 |
| 4,222,541 | 9/1980 | Cillis | 248/210 |
| 4,386,753 | 6/1983 | Smith | 248/210 |
| 4,425,984 | 1/1984 | LaChance | 182/106 |
| 4,445,659 | 5/1984 | LaChance | 182/120 |

*Primary Examiner*—Reinaldo P. Machado
*Attorney, Agent, or Firm*—Donald W. Meeker

[57] ABSTRACT

A sleeve fits securely over a ladder rail with attached hooks over at least two rungs of the ladder. Attached to the side of the sleeve are a rigid hand rail and pivotable utility tray. Clips on the side of the tray hold tools. Supplies and tools are stored in the tray or the tray may be a paint roller tray. A slot or groove in either the sleeve or an extension of the tray permits tilting of the tray to a desired angle relative to the ladder. A bolt through one of the hooks secures the sleeve in place and permits the sleeve to be used upside-down on an opposite ladder rail. The sleeve may be constructed from a single sheet of material cut and bent into shape.

19 Claims, 7 Drawing Figures

MOVABLE HAND RAILING AND TRAY FOR LADDERS

BACKGROUND OF THE INVENTION

1. Technical Field

The invention pertains to ladder attachments in the form of movable brackets mounted frontally on the rungs and in particular to a movable combination bracket with a hand rail and utility tray for tools and supplies.

2. Background Art

Most brackets and holders for equipment on ladders are either very loosely connected to the ladder, such as removable hooks and the like, or very rigidly attached to the ladder and not easily moved. This results in spilling paint or dropping tools with the loose brackets and in having to move back and forth from the work position to the bracket position on the ladder if the bracket remains secured to one place on the ladder.

Most work ladders do not provide handrails for safety in using the ladder. In cases, such as fire-fighting apparatus, or permanently installed ladders used in place of stairs as on a ship, the handrails are permanently secured to the ladders and would be very difficult to remove or shift in position on the ladder.

Rigidly attached tool holders would not take into account various angles of ladder positioning and would not always be in the optimum orientation for maintaining tools and supplies in the proper orientation for ease of handling and not spilling.

Most ladder attachments are not reversible on the ladder for both left and right side rail use.

DISCLOSURE OF INVENTION

A primary object of the present invention is to provide a stable bracket for ladders which can be moved swiftly and easily up and down the ladder wherever required by the user. This object is accomplished by constructing a front-mounted bracket with a sleeve to fit over the ladder side rail and hooks to engage at least two rungs of the ladder.

Another object of the invention is to provide, attached to the bracket, a handrail which also serves as a handle for moving the bracket as needed on the ladder. Wherever the user may be on the ladder, by moving the handrail with the user, there is always a safety grip within easy reach to maintain proper balance on the ladder.

A further object of the invention is to provide a movable tool and supply holder for the user by attaching a pivotable tray to the bracket so that the tray may always be moved with the user to keep necessary tools and supplies close at hand wherever the user may be one the ladder, and the tray may be pivoted to maintain proper horizontal orientation despite the angle of the ladder.

By providing an elongated hook over at least on rung with a bolt or other removable fastener between the end of the hook and the opposing side of the hook (thereby encircling the rung), the bracket can remain on the ladder while moving or storing and the bracket may be used interchangeably on either ladder side rail.

Forming the bracket entirely of one piece of sheet metal or other flat still sheet material, by bending and cutting, the sheet provides a bracket for ladders which is simple to fabricate.

BRIEF DESCRIPTION OF THE DRAWINGS

These and other details and advantages of my invention will be described in connection with the accompanying drawings, which are furnished only by way of illustration and not in limitation of the invention, and in which drawings.

BEST MODE FOR CARRYING OUT THE INVENTION

Figure 1:
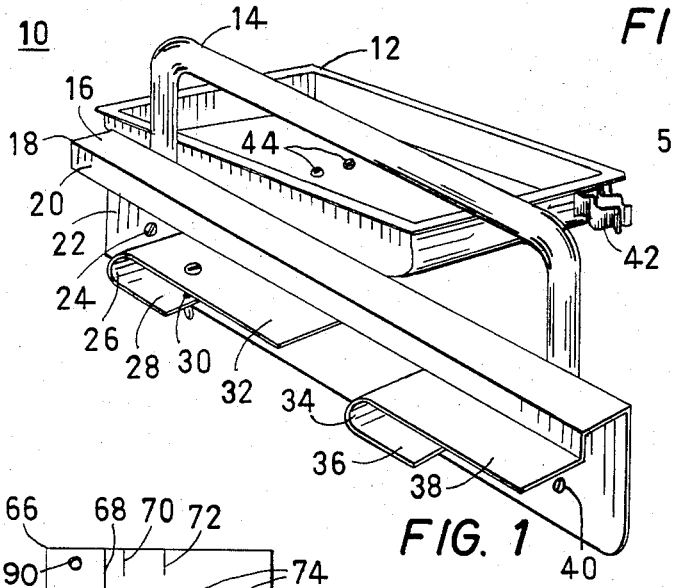
FIG. 1 is a perspective view of the preferred embodiment of the invention with a hand rail and utility tray attached to the sleeve and hooks bracket.
Figure 2:
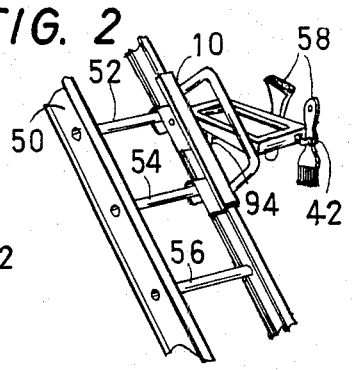
FIG. 2 is a perspective view of the preferred embodiment of the invention mounted on a ladder with tools clipped onto the tray.

In FIGS. 1 and 2 the preferred embodiment of the movable ladder bracket 10 comprises a sleeve 18 which partially envelopes a side rail of a ladder, and rigidly attached to the sleeve, a U-shaped hand rail 14 and pivotally attached to the sleeve, a utility tray 12 for holding supplies and tools inside a rectangular foursided tray and tools 58 removably secured to one or more clamps 42 secured by rivets or bolts to the exterior sides of the tray.

Figure 4:
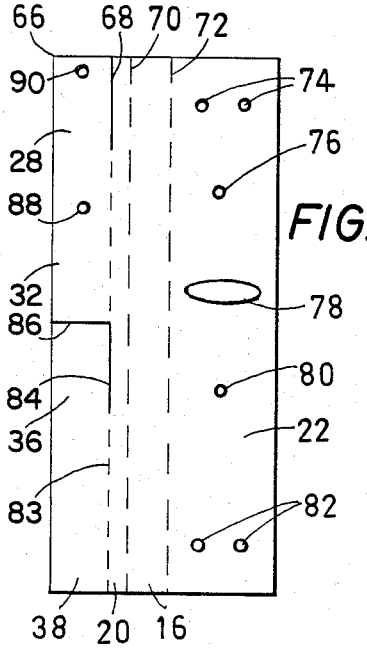
FIG. 4 is a plan view of the single sheet of material cut along the solid lines and folded along the dashed lines to form the sleeve and hooks bracket.

Extending between at least two rungs on the ladder, the sleeve 18 is formed from a rigid sheet material, such as galvanized sheet metal (18–20 gauge preferred), and may be formed of separate sheets secured together as by welding, or preferably formed from a single sheet cut and bent as indicated in FIG. 4 to form both the sleeve and the hooks 26 and 34.

An elongated rectangular exterior side portion 22 of the sleeve extends in width from the top edge of the ladder side rail to the bottom edge of the ladder side rail and extends in length over at least the distance between two rungs on the ladder. Permanently secured orthogonally along the top edge of the sleeve side portion extending laterally inward therefrom, a narrow elongated sleeve top portion 16 extends, in width, across the top of the ladder rail and extends, in length, equal to the sleeve exterior side portion. Permanently secured along the interior edge of the sleeve top portion extending orthogonally downward therefrom, a sleeve interior side portion 20 extends in width from the top of the ladder rail to the front edges of the rungs of the ladder. Permanently secured to the bottom edge of the sleeve interior side portion and extending orthogonally laterally inward therefrom, at least two hooks 26 and 34 are curved downward to hook over each of at least two ladder rungs 52 and 54. Each hook has a flat flange 32 and 38 connected to the sleeve interior side and a curved hook 26 and 34. At least one of the hooks is further provided with a flat extension 28 and 36 below the hook portion, at elast one of which extensions is further provided with a opening spaced apart from the hook a distance slightly greater than the diameter of the ladder rung, through which opening a rigid removable securing means 30 such as a bolt passes through the extension opening into a matching opening in the flat flange and is secured therein by an easily removable means such as a butterfly nut. When the hook 26 is placed over the ladder rung, the bolt 30 may be secured, thereby encircling the rung, to hold the sleeve on the ladder until the bolt is removed. The ladder may then be moved without knocking the sleeve off and also the sleeve may then be used upside-down on the opposite ladder rail as in FIG. 6 and the bolt 30 will serve as the top of the hook over the ladder rung 56.

Hooking over the ladder rungs prevents the movable bracket 10 from falling downward and the three-sided sleeve conforming to the shape of the ladder rail provides lateral stability to prevent the utility bracket from tilting to the side for a rigid support on the ladder, to which support utilitarian devices may be attached such as a hand rail or a utility tray.

Figure 7:
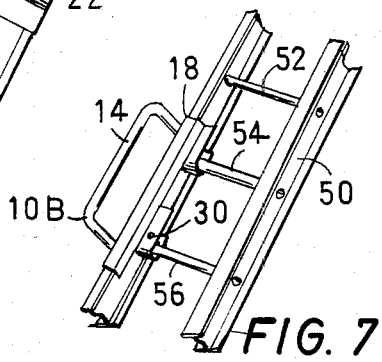
FIG. 7 is a perspective view of another alternate embodiment of the invention mounted on a left side rail of a ladder and having only a hand rail attached to the sleeve.

On the outside of the sleeve exterior side a U-shaped hand rail 14 is permanently and rigidly secured to the sleeve by conventional means 24 and 40 such as bolts or rivets. The hand rail serves not only as a means of safety on the ladder for grasping in working and climbing or when losing balance, but also as a handle means for lifting the sleeve to move to any desired location on the ladder by lifting the sleeve upward and slipping the hooks off of the rungs and then placing the hooks over the rungs at the next desired position on the ladder. An alternate embodiment of the movable bracket 10B in FIG. 7 provides sleeve 18 which is provided only with a hand rail 14 and no tray, serving exclusively as a movable hand rail.

Figure 5:
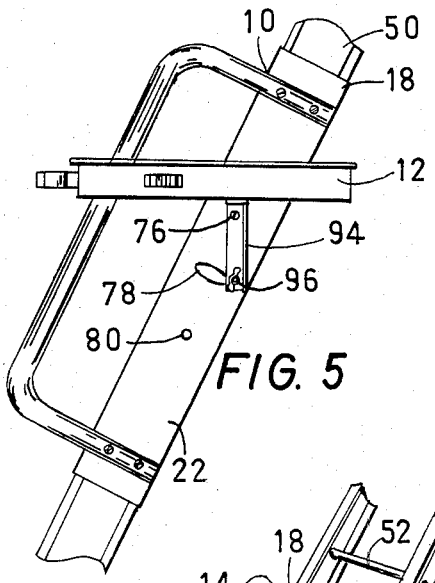
FIG. 5 is a side elevation view of the preferred embodiment of the invention mounted on a ladder showing one pivotal attachment means for mounting the tray to the sleeve.

In FIGS. 1, 2, 5, and 6 a utility tray 12 is pivotally attached to the outside of the sleeve exterior side 22. The tray is preferably a shallow rectangular four-sided container for supplies and tools which might be used on a ladder. Constructed of rigid sheet metal or plastic, the tray is further provided with one or more clips 42 or other means secured to the outside walls of the tray to hold tools 58 around the periphery of the tray. In FIGS. 2 and 5 the means of pivotally attaching the tray 12 to the sleeve comprises an elongated member 94 secured to the bottom of the tray by bolts or rivets or other conventional attaching means 44 and extending downwardly from the tray bottom. The elongated member is provided, at its top, with an opening which aligns with the top opening 76 in the sleeve exterior side wall (for mounting on the right ladder rail or aligns with the bottom opening 80 for left ladder rail mounting) and further provided, at its bottom, with a second opening which aligns with a transverse slot 78 in the sleeve exterior side 22 located midway between the sleeve openings 76 and 80. A removable pivoting attaching means, such as a bolt and nut with washers, is secured between the top opening in the elongated member 94 and the sleeve opening 76 (or 80). A tight but removable securing means 96, such as a bolt and butterfly nut, are secured through the bottom elongated member opening and the sleeve slot 78. The tray may be tilted to any desired angle relative to the sleeve depending upon the ladder angle (a horizontal tray is usually desirable) with the bottom securing means 96 sliding in the slot 78 until the tray is properly adjusted and the securing means tightened to secure the tray in a rigid position for working.

Figure 6:
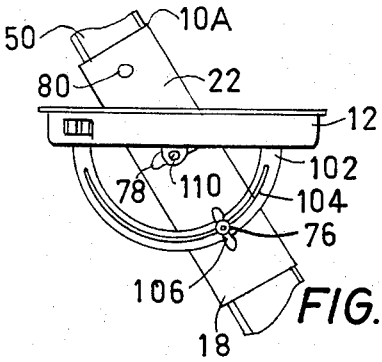
FIG. 6 is an alternate embodiment of the invention mounted on a left side rail of a ladder and having only a tray mounted to the sleeve by a second variation of a pivotal mounting means for the tray on the sleeve.

In FIG. 6 an alternative means of pivotally attaching the tray to the sleeve provides an arcuate member 102 provided with a central open groove 104 along its curved length. The arcuate member is permanently secured to a side wall of the tray adjacent to the sleeve or to the bottom of the tray adjacent to the sleeve by a conventional attaching means such as a rivet or nut and bolt. A small flange 110 with an opening extends downward from the bottom of the tray midway between the two ends of the arcuate member and the flange is permanently secured to the tray by conventional means such as a rivet or nut and bolt either to the side or the bottom of the tray adjacent to the sleeve. A pivoting attaching means, such as a bolt and nut and washers, is secured through the tray flange 110 into sleeve slot 78 (which may be just a small opening for this arcuate type of pivoting means). A secure but adjustable attaching means, such as a bolt and wingnut 106 is secured through the groove 104 and into the bottom sleeve opening 76 (in this case because the sleeve is mounted on the left ladder rail; when the sleeve is mounted on the right ladder rail it would be sleeve opening 80). The tray 12 is pivoted to the desired angle relative to the sleeve (usually so that the tray is horizontal) with the groove sliding over the bolt and wingnut until the desired orientation is reached and the wingnut is tightened to secure the tray at the desired angle.

In FIG. 6 an alternate embodiment of the movable bracket 10A provides just the utility tray 12 mounted on the sleeve 18 with no hand rail, thereby serving exclusively as a movable utility tray bracket.

In FIG. 4 the sleeve may be constructed from a single sheet of material 66 cut along the solid lines and bent along the dashed lines as indicated. The widest panel on the right is the sleeve exterior side portion 22 with a pair of openings cut through at the top 74 and a pair of openings cut through at the bottom 82 to receive the fasteners 24 and 40 (in FIG. 1) from the hand rail 14. Centrally located openings 76, 78 and 80 receive fasteners from the utility tray 12. The sheet 66 is bent at a right angle along a line 72 parallel to the right edge and then bent again at a right angle along a second line 70 parallel to the first and spaced from the first a distance slightly greater than the width of the ladder rail to form the sleeve top portion 16 between the two bends. A third bend is then made at a right angle, but in an opposite direction to the first two bends, along a line 83 parallel to the other two lines 70 and 72 spaced from the second bend line 70 by a distance equal to the distance from the top of the ladder rail to the front edge of the rungs, thereby forming the sleeve interior side 20 between the second and third bends.

With the remaining panel on the left of the sheet 66 between the third bend 83 and the left edge, the two hooks are formed. Approximately midway along the left edge a cut 86 is made through the sheet from the side edge of the sheet to the third bend 83. The same cut is continued at a right angle downward 84 along the third bend line a distance greater than the perimeter of the ladder rung. Another cut 68 is made along the third bend line 83 from the top of the sheet downward a distance slightly greater than the perimeter of the ladder rung. The two partially cut-away tabs 28 and 36 are each bent into a curve, slightly greater in diameter than the thickness of a ladder rung, away from the third bend to form the two hooks 26 and 34. Openings 88 and 90 are cut or drilled through the top hook at a distance from the top of the hook greater than the thickness of the ladder rung, with the openings in alignment across the sides of the hook so that the bolt 30 may be secured between them after the sleeve has been installed on the ladder rungs. The hand rail and utility tray are then installed on the sleeve exterior side 22.

Figure 3:
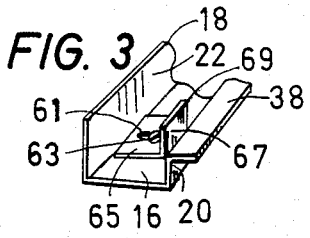
FIG. 3 is a partial perspective view showing an end of an alternate embodiment of the sleeve further provided with an adjusting means for ladders of different rail sizes.

In FIG. 3 an alternate embodiment of the sleeve 18, shown inverted, is further provided with at least two holes through the sleeve top portion 16 one hole at each end. A width adjusting angle 69 is slidably installed with a screw 63 and nut through a slot 61 in one wing 65 of the angle and through one of the holes in the sleeve with the slotted wing flat against the sleeve. The adjusting angle slides until the distance between the upright wing 67 and the exterior sleeve side 22 is equal to the thickness of the ladder rail. The screw 63 is tightened securing the adjusting angle to the sleeve. The sleeve is adjustable for various sizes of ladders.

The movable bracket with either the hand rail, the utility tray or both installed is easily moved to any position on the ladder simply by lifting the hooks free of the ladder rungs and hooking the hooks onto other ladder rungs elsewhere on the ladder as desired with a straight forward up and down motion while maintaining good balance on the ladder, since no side motion is required. Used on either side rail of the ladder, the invention may be removably secured with a bolt 30 through one of the hooks and the tray tilted to any desired angle regardless of the angle of the ladder. The tray may hold tools and supplies including a paint tray or paint can, or the tray itself may be a paint tray used with a paint roller. Tools, such as scrapers and paint brushes 58 and paint rollers may be secured to the sides of the tray on the clips.

It is understood that the preceding description is given merely by way of illustration and not in limitation of the invention and that various modifications may be made thereto without departing from the spirit of the invention as claimed.

I claim:

1. A movable utility bracket for ladders comprising:

a sleeve contacting and conforming to a side rail of a ladder, wherein the sleeve extends over a length of the side rail equal to a distance between at least two ladder rungs and the sleeve covers a top edge and an external side of the side rail from the top edge to the bottom edge, and further covers, an interior side of the side rail to an edge of each of the rungs;

at least two hooks protruding interiorly from the sleeve, each of which hooks partially encircles one of the rungs over a top of the rung thereby providing a bracket which slides onto a ladder hooked over the rungs of the ladder securely but instantly removable to other rungs on the ladder;

a means of securing a utility device to the bracket for use by a person on the ladder, wherein the utility device comprises a handrail secured to the exterior of the bracket and protruding upwardly above the ladder for grasping by the person using the ladder, wherein the hand rail comprises a substantially U-shaped member with each of two arms of the U rigidly attached flat against the side of the sleeve.

2. A movable utility bracket for ladders comprising:

a sleeve contacting and conforming to a side rail of a ladder, wherein the sleeve extends over a length of the side rail equal to a distance between at least two ladder rungs and the sleeve covers a top edge and an external side of the side rail from the top edge to the bottom edge, and further covers, an interior side of the side rail to an edge of each of the rungs;

at least two hooks protruding interiorly from the sleeve, each of which hooks partially encircles one of the rungs over a top of the rung thereby providing a bracket which slides onto a ladder hooked over the rungs of the ladder securely but instantly removable to other rungs on the ladder;

a means of securing a utility device to the bracket for use by a person on the ladder, wherein the utility device comprises a tray pivotally attached to the side of the sleeve to serve as a holder for tools and supplies normally used on a ladder, wherein the tray comprises a substantially flat bottom, four upwardly extending sides, tool supporting means and a pivotal connection means which allows rotation of the tray relative to the bracket enabling a user to maintain the tray in a substantially horizontal position;

wherein the pivotal connection means comprises an elongated member extending downwardly from the tray on a side of the tray adjacent to the ladder and two spaced openings along the exterior side of the sleeve wherein one of the sleeve openings is elongated laterally across the sleeve side, removable attaching means from each of two ends of the elongated member to each of the two sleeve openings, so that the attached means in the elongated opening moves adjustably within the elongated opening to cause the tray to pivot relative to the sleeve.

3. A movable utility bracket for ladders comprising:

a sleeve contacting and conforming to a side rail of a ladder, wherein the sleeve extends over a length of the side rail equal to a distance between at least two ladder rungs and the sleeve covers a top edge and an external side of the side rail from the top edge to the bottom edge, and further covers, an interior side of the side rail to an edge of each of the rungs;

at least two hooks protruding interiorly from the sleeve, each of which hooks partially encircles one of the rungs over a top of the rung thereby providing a bracket which slides onto a ladder hooked over the rungs of the ladder securely but instantly removable to other rungs on the ladder;

a means of securing a utility device to the bracket for use by a person on the ladder;

wherein the sleeve and hooks are formed from one sheet of stiff material bent from the exterior side rail portion inwardly at a right angle to conform to the top edge of the ladder, and bent inwardly at a right angle around an interior corner of the top edge of the ladder to conform to the interior side of the ladder rail, and bent outwardly at a right angle at a front edge of the rungs to form a flat flange from which the hooks are formed by partially cutting the flange along the bent edge opposite each rung upwardly to a point midway between the rungs and further cutting laterally through the width of a flange at the midway point between the rungs to form a tab-like strip opposite each rung, which strip is then bent inwardly to form a hook to hook over the rung and conform to the shape of the rung securing the bracket removable to the ladder.

4. The utility bracket of claim 3 wherein at least one bent-over hook extends below the bottom of the rung and the extended portion is provided with an opening therethrough which aligns with a matching opening through an unbent portion of the hook and a removable securing means is connected through the openings to secure the bracket to the ladder to the extent that the ladder may be moved with the bracket in place and the bracket may be used interchangeably on either ladder rail.

5. A combined movable bracket and handrail for ladders comprising:

a sleeve contacting and conforming to a side rail of a ladder, wherein the sleeve extends over a length of the side rail equal to a distance between at least two ladder rungs and the sleeve covers a top edge and an external side of the side rail from the top edge to a bottom edge, and further covers an interior side of the side rail to an edge of each of the rungs;

at least two hooks protruding interiorly from the sleeve, each of which hooks partially encircles one of the rungs over a top of the rung thereby providing a bracket which slides onto a ladder, hooked over the rungs of the ladder securely in both a vertical and lateral direction, but instantly removable to other rungs on the ladder;

a combined handrail and handle for moving the bracket comprising a U-shaped member with a hand-grip portion and two arms wherein each of the two arms is rigidly secured to the exterior side of the sleeve.

6. The bracket of claim 5 further comprising a utility tray pivotally attached to the exterior side of the sleeve to serve as a holder for tools and supplies normally used on a ladder, wherein the tray comprises a substantially flat bottom, four upwardly extending sides, tool supporting means and a pivotal connection means which allows rotation of the tray relative to the bracket enabling a user to maintain the tray in a substantially horizontal position.

7. The utility bracket of claim 6 wherein the pivotal connection means comprises an elongated member extending downwardly from the tray on a side of the tray adjacent to the ladder and two spaced openings along the exterior side of the sleeve wherein one of the sleeve openings is elongated laterally across the sleeve side, removable attaching means from each of two ends of the elongated member to each of the two sleeve openings, so that the attaching means in the elongated opening moves adjustably within the elongated opening to cause the tray to pivot relative to the sleeve.

8. The utility bracket of claim 6 wherein the pivotal connection means comprises an arcuate member extending from the side of the tray adjacent to the sleeve and wherein the arcuate member is provided with a central open groove along its length, a pivotal connector from the tray to one sleeve opening and an adjustable connector through the groove into the second sleeve opening, so that the tray may be adjusted to any desired angle by changing the position of the groove connector.

9. The utility bracket of claim 6 wherein the tray is a paint roller tray and tool supporting means comprises at least one clip mounted externally on the tray for holding paint brushes and rollers.

10. The utility bracket of claim 5 wherein an end of one of the hooks extends below the rung of the ladder and a removable elongated attaching means is secured from the extended end of the hook to the remainder of the hook under the rung securing the utility bracket in place until the attaching means is removed.

11. The utility bracket of claim 5 wherein the sleeve and hooks are formed from one sheet of stiff material bent from the exterior side rail portion inwardly at a right angle to conform to the top edge of the ladder, and bent inwardly at a right angle around an interior corner of the top edge of the ladder to conform to the interior side of the ladder rail, and bent outwardly at a right angle at a front edge of the rungs to form a flat flange from which the hooks are formed by partially cutting the flange along the bent edge opposite each rung upwardly to a point midway between the rungs and further cutting laterally through the width of the flange at the midway point between the rungs to form a tab-like strip opposite each rung which strip is then bent inwardly to form a hook to hook over the rung and conform to the shape of the rung securing the bracket removably to the ladder.

12. The utility bracket of claim 11 wherein at least one bent-over hook extends below the bottom of the rung and the extended portion is provided with an opening therethrough which aligns with a matching opening through an unbent portion of the hook and a removable securing means is connected through the openings to secure the bracket to the ladder to the extent that the ladder may be moved with the bracket in place and the bracket may be used interchangeably on either ladder rail.

13. A combination movable utility bracket and handrail for ladders comprising:

a sleeve contacting and conforming to a side rail of a ladder, wherein the sleeve extends over a length of the side rail equal to a distance between at least two ladder rungs and the sleeve covers a top edge and an external side of the side rail from the top edge to a bottom edge, and further covers an interior side of the side rail to an edge of each of the rungs;

at least two hooks protruding interiorly from the sleeve, each of which hooks partially encircles one of the rungs over a top of the rung thereby providing a bracket which slides onto a ladder, hooked over the rungs of the ladder securely in both a vertical and lateral direction, but instantly removable to other rungs on the ladder;

a combined handrail and handle for moving the bracket comprising a U-shaped member with a hand-grip portion and two arms wherein each of the two arms is rigidly secured to the exterior side of the sleeve;

and a utility tray pivotally shaped attached to the exterior side of the sleeve to form a holder for tools and supplies normally used on a ladder, wherein the tray comprises a substantially flat bottom, four upwardly extending sides, tool supporting means and a pivotal connection means which allows rotation of the tray relative to the bracket enabling a user to maintain the tray in a substantially horizontal position.

14. The invention of claim 13 wherein the sleeve and hooks are formed from one sheet of stiff material bent from the exterior side rail portion inwardly at a right angle to conform to the top edge of the ladder, and bent inwardly at a right angle around an interior side of the ladder rail, and bent outwardly at a right angle at a front edge of the rungs to form a flat flange from which the hooks are formed by partially cutting the flange along the bent edge opposite each rung upwardly to a point midway between the rungs and further cutting laterally through the width of the flange at the midway point between the rungs to form a tab-like strip opposite each rung, which strip is then bent inwardly to form a hook to hook over the rung and conform to the shape of the rung securing the bracket removably to the ladder.

15. The invention of claim 14 wherein at least one bent-over hook extends below the bottom of the rung and the extended portion is provided with an opening therethrough which aligns with a matching opening through an unbent portion of the hook and a removable securing means is connected through the openings to secure the bracket to the ladder to the extent that ladder may be moved with the bracket in place and the bracket may be used interchangeably on either ladder rail.

16. The invention of claim 13 wherein the pivotal connection means comprises an elongated member extending downwardly from the tray on a side of the tray adjacent to the ladder and two spaced openings along the exterior side of the sleeve wherein one of the sleeve openings is elongated laterally across the sleeve side, removably attaching means from each of two ends of the elongated member to each of the two sleeve openings, so that the attaching means in the elongated opening moves adjustably within the elongated opening to cause the tray to pivot relative to the sleeve.

17. The invention of claim 13 wherein the pivotal connection means comprises an arcuate member extending from the side of the tray adjacent to the sleeve and wherein the arcuate member is provided with a central open groove along its length, a pivotal connector from the tray to one sleeve opening and an adjustable connector through the groove into the second sleeve opening, so that the tray may be adjusted to any desired angle by changing the position of the groove connector.

18. The invention of claim 13 wherein the tray is a paint roller tray and the tool supporting means comprises at least one clip mounted externally on the tray for holding paint brushes and rollers.

19. The invention of claim 13 further provided with an adjusting means slidable secured within the sleeve to narrow the sleeve width to accommodate ladder rails of various thicknesses.

* * * * *